US008237746B2

(12) United States Patent
Betts-LaCroix

(10) Patent No.: US 8,237,746 B2
(45) Date of Patent: Aug. 7, 2012

(54) PIXEL-LEVEL POWER OPTIMIZATION FOR OLED DISPLAYS

(75) Inventor: Jonathan Betts-LaCroix, San Francisco, CA (US)

(73) Assignee: Google Inc., Mountain View, CA (US)

( * ) Notice: Subject to any disclaimer, the term of this patent is extended or adjusted under 35 U.S.C. 154(b) by 264 days.

(21) Appl. No.: 12/538,843

(22) Filed: Aug. 10, 2009

(65) Prior Publication Data

US 2010/0149218 A1 Jun. 17, 2010

Related U.S. Application Data

(60) Provisional application No. 61/087,630, filed on Aug. 8, 2008.

(51) Int. Cl.
*G09G 5/00* (2006.01)

(52) U.S. Cl. ..... 345/670; 345/581; 345/619; 345/612; 345/698; 345/55; 345/84

(58) Field of Classification Search ..... None
See application file for complete search history.

(56) References Cited

U.S. PATENT DOCUMENTS

| | | | | |
|---|---|---|---|---|
| 5,717,604 | A * | 2/1998 | Wiggins | 709/229 |
| 2004/0207653 | A1* | 10/2004 | Stavely et al. | 345/698 |
| 2006/0090180 | A1* | 4/2006 | Uz | 725/39 |
| 2008/0155466 | A1* | 6/2008 | Lee | 715/810 |

* cited by examiner

*Primary Examiner* — Kee M Tung
*Assistant Examiner* — Jwalant Amin
(74) *Attorney, Agent, or Firm* — Morris & Kamlay LLP

(57) ABSTRACT

A method enables power savings in an OLED display by reducing the size of the screen in an OLED display when the screen is not in use. For example, if the OLED display receives no input from the user for a predefined time period, the size of the screen is reduced in order to decrease the power consumption of the OLED display.

7 Claims, 2 Drawing Sheets

PIXEL-LEVEL POWER OPTIMIZATION FOR OLED DISPLAYS

This application claims priority from U.S. Provisional Patent Application Ser. No. 61/087,630, entitled PIXEL-LEVEL POWER OPTIMIZATION FOR OLED DISPLAYS, filed on Aug. 8, 2008, which is hereby incorporated by reference as if set forth in full in this application for ail purposes.

BACKGROUND

An organic light-emitting diode (OLED) is a light-emitting diode having an emissive electroluminescent layer containing organic compounds. In an OLED display, OLEDs function as picture elements or pixels arranged in a two-dimensional grid or array, where each pixel represents a portion a displayed image. OLED technology is used in display systems such as computer displays, personal digital assistant (PDA) screens, television screens, etc. Unlike liquid crystal displays (LCDs), OLED displays do not require a backlight to function and thus consume far less power than LCDs. However, continual improvements in power efficiency remains desirable, especially as portable computing devices become smaller.

SUMMARY OF EMBODIMENTS OF THE INVENTION

A method enables power savings in an OLED display by reducing the size of the screen in an OLED display when the screen is not in use. For example, if the OLED display receives no input from the user for a predefined time period, the size of the screen is reduced in order to decrease the power consumption of the OLED display.

In one embodiment the invention provides a method for implementing a display, the method comprising: detecting inactivity in a screen of the display; and reducing a size of the screen.

DETAILED DESCRIPTION OF THE INVENTION

Figure 1:
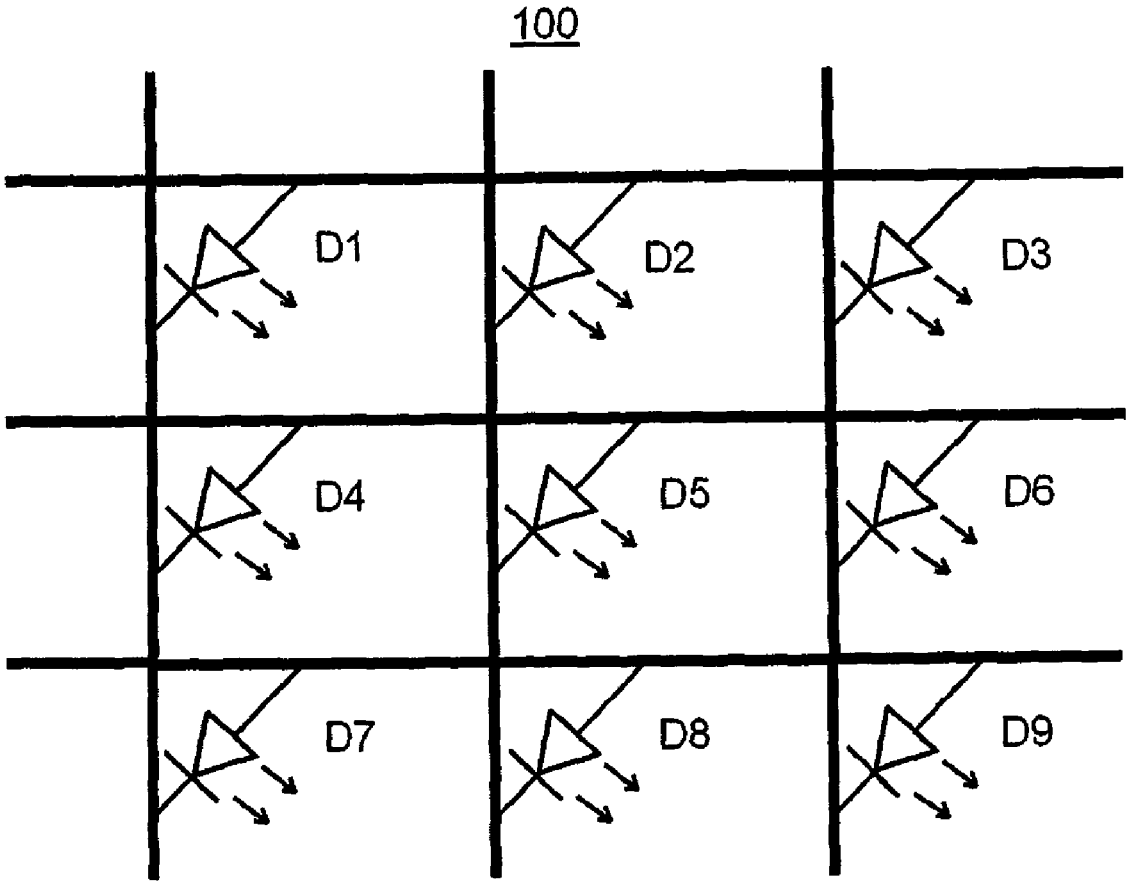
FIG. 1 is an example schematic diagram of an OLED array used in an OLED display.

FIG. 1 is an example schematic diagram of an OLED array 100 used in an OLED display. In FIG. 1, OLED array 100 includes a two-dimensional array of OLEDs D1-D9. In a given application, OLEDs D1-D9 function as picture elements or pixels, where each pixel represents a portion of a displayed image or object. Although only a 3×3 array is shown for simplicity, embodiments described herein may be applied to arrays of larger sizes (e.g., 800×600, 1280×720, etc.). OLED array 100 may be used in OLED displays of any type of computing device such as a personal computer, laptop, ultra-portable computer, cell phone, audio player, navigation or location system, or any other device.

Figure 2A:
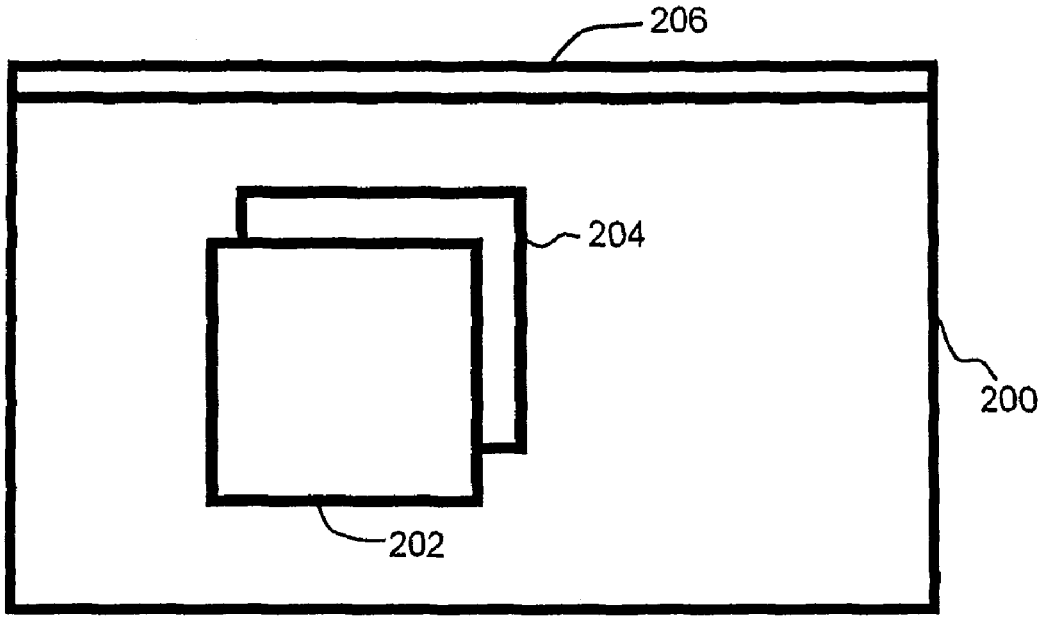
FIG. 2A illustrates an example OLED display showing a full-sized screen.

FIG. 2A illustrates an example OLED display showing a full-sized screen 200. The screen 200 includes objects or images such as an active window 202, an inactive window 204, and a tool bar 206. In one embodiment, the software application detects inactivity in the screen 200 of the display.

For example, if the display does not receive any input from the user via the computer or system incorporating the OLED display, the computer or system may go into a power-conservation mode and may put the OLED display into a power-conservation or low-power mode. Such a mode may occur, for example, after 5 minutes of inactivity. The time period may be a default time period or may be set by the user. In one embodiment, after the software application detects inactivity in the screen 200, the software application begins to reduce the size of the screen.

Figure 2B:
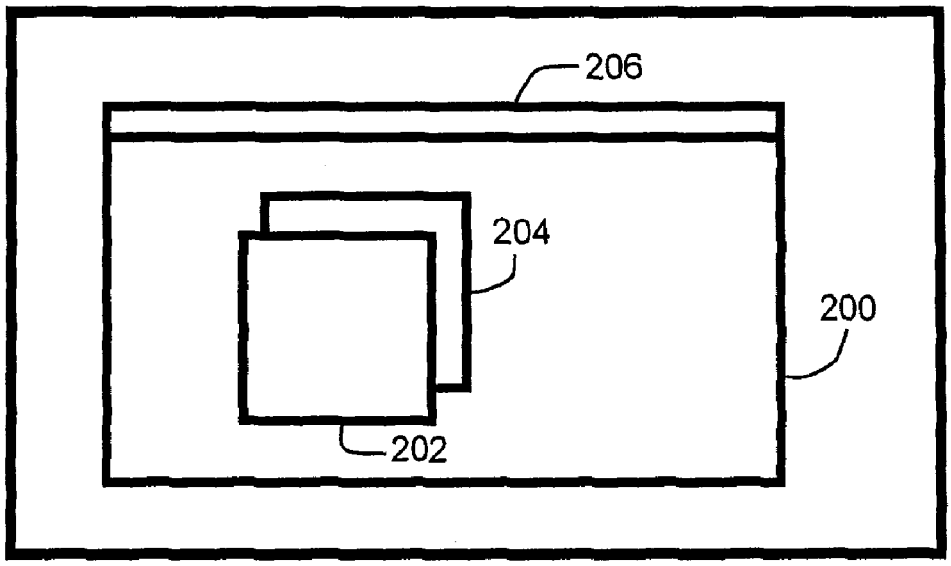
FIG. 2B illustrates an example OLED display showing the screen of FIG. 2A with a reduced size.

In one embodiment, the software application may reduce the size of the screen in increments over time. For example, when the software application reduces the size of the screen 200, the screen size may be reduced from 720×400 to 640×350 after 10 seconds. After another 10 seconds, the screen size may be reduced from 640×350 to 320×200, etc. FIG. 2B illustrates an example OLED display showing the screen 200 of FIG. 2A with a reduced size. Because of the reduced screen size, fewer OLEDs are required to be on in order to generate the image of the screen 200 and its contents. As such, in one embodiment, the software application may then disable or turn off the OLEDs and/or rows of OLEDs that are not contributing to the generation of the screen 200 and its contents. This results in substantial power savings.

In one embodiment, when the software application reduces the size of the screen 200, the software application may also periodically move the screen 200 to different locations in order to prevent burn-in effects of the screen image. For example, the software application may move the screen to different corners of the OLED display.

In one embodiment, the software application may also disable particular OLEDS (e.g., every other OLED or random OLEDs) or may disable particular rows of OLEDs (e.g., every other row of OLEDs) in order to achieve a similar effect of decreasing power consumption. Because the software application performs these functions while the screen is inactive, power consumption is reduced without compromising the user experience.

In particular embodiments, once the user provides input to the OLED display (e.g., moving the mouse), the software application restores the screen 200 back to its full size and/or enables all OLEDs and/or rows of OLEDs.

The embodiments described herein result in lower power consumption in OLED systems, without compromising the user experience. The lower power consumption is especially beneficial in mobile device applications where improved battery life is highly valued. Furthermore, these embodiments increase the lifespan of OLEDs and OLED displays in general due to the overall decreased usage of the OLEDs.

Although specific embodiments of the invention have been described, variations of such embodiments are possible and are within the scope of the invention.

Any suitable programming language can be used to implement the functionality of the present invention including C, C++, Java, assembly language, etc. Different programming techniques can be employed such as procedural or object oriented. The routines can execute on a single processing device or multiple processors. Although the steps, operations or computations may be presented in a specific order, this order may be changed in different embodiments unless otherwise specified. In some embodiments, multiple steps shown as sequential in this specification can be performed at the same time. The sequence of operations described herein can be interrupted, suspended, or otherwise controlled by another process, such as an operating system, kernel, etc. The routines can operate in an operating system environment or as stand-alone routines occupying all, or a substantial part, of the system processing. The functions may be performed in hardware, software or a combination of both.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

A "processor" or "process" includes any human, hardware and/or software system, mechanism or component that processes data, signals or other information. A processor can include a system with a general-purpose central processing unit, multiple processing units, dedicated circuitry for achieving functionality, or other systems. Processing need not be limited to a geographic location, or have temporal limitations. Functions and parts of functions described herein can be achieved by devices in different places and operating at different times. For example, a processor can perform its functions in "real time," "offline," in a "batch mode," etc. Parallel, distributed or other processing approaches can be used.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Embodiments of the invention may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of the present invention can be achieved by any means as is known in the art. Distributed, or networked systems, components and circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope of the present invention to implement a program or code that can be stored in a machine-readable medium to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

Thus, the scope of the invention is to be determined solely by the appended claims.

The invention claimed is:

1. A method, the method comprising:

presenting content in a full-sized screen on a display device, wherein the screen comprises a plurality of individual pixel elements in which each individual pixel element is generated from individual light emitting diodes;

detecting inactivity by a user device for a first predetermined time period, wherein the first predetermined time period is set by a user;

reducing the full-sized screen to present the entire content in a first reduced-sized screen by disabling individual light emitting diodes representing respective individual pixel elements of the full-sized screen and presenting the full-sized screen content in the first reduced-sized screen, wherein the first reduced-sized screen is a portion of the full-sized screen and the disabled light emitting diodes correspond to individual pixel elements;

detecting further inactivity from a user device for a second predetermined time period, wherein the second predetermined time period is measured from the end of the first predetermined time period;

reducing the first reduced-sized screen to present the content in a second reduced-sized screen by disabling individual light emitting diodes representing the first reduced-sized screen and presenting the full-screen content in the second reduced-sized screen, wherein the second reduced-sized screen is a portion of the first reduced-sized screen and the disabled light emitting diodes correspond to additional pixel elements in the first reduced-sized screen; and in response to a detection of a user input, enabling all of the light emitting diodes that form the full-sized screen, and present the content in the full-size screen, wherein the pixel elements are disabled by turning off power to the corresponding light emitting diodes.

2. The method of claim 1, wherein alternate pixel elements are disabled in a row or in a column of the screen.

3. The method of claim 1, wherein the pixel elements are randomly disabled in the screen.

4. The method of claim 1, wherein alternate rows or columns of pixel elements are disabled in the screen.

5. The method of claim 1, wherein the first time period is longer than the second time period.

6. The method of claim 1, further comprising:

reducing the second reduced-sized screen to present the content in a third reduced-sized screen by disabling individual light emitting diodes representing the second reduced-sized screen and presenting the full-screen content in the third reduced-sized screen, wherein the third reduced-sized screen is a portion of the second reduced-sized screen and the disabled light emitting diodes correspond to further additional pixel elements in the second reduced-sized screen.

7. A method comprising:

presenting content in a screen on a display device, wherein the screen includes a matrix of light emitting diodes and the presented content is displayed using only a sub-matrix of the light emitting diodes;

detecting inactivity by a user device for a first predetermined time period, wherein the first predetermined time period is set by a user; detecting further inactivity from a user device for a second predetermined time period, wherein the second predetermined time period is measured from the end of the first predetermined time period; reducing the first reduced-sized screen to present the content in a second reduced-sized screen by disabling individual light emitting diodes representing the first reduced-sized screen and presenting the full-screen content in the second reduced-sized screen, wherein the second reduced-sized screen is a portion of the first reduced-sized screen and the disabled light emitting diodes correspond to additional pixel elements in the first reduced-sized screen; in response to a detection of a user input, enabling all of the light emitting diodes that form the full-sized screen, and presenting the content in the full-size screen; and in response to the detected inactivity, disabling only light emitting diodes surrounding the sub-matrix of light emitting diodes used to generate the presented content.

* * * * *